US005911865A

United States Patent [19]

Yih

[11] Patent Number: 5,911,865

[45] Date of Patent: Jun. 15, 1999

[54] METHOD FOR ELECTROPLATING OF MICRON PARTICULATES WITH METAL COATINGS

[76] Inventor: Pay Yih, 862-H Robin Rd., Amherst, N.Y. 14228

[21] Appl. No.: 08/837,299

[22] Filed: Apr. 11, 1997

Related U.S. Application Data

[63] Continuation-in-part of application No. 08/796,204, Feb. 7, 1997, abandoned.

[51] Int. Cl.[6] ..... C25D 7/00

[52] U.S. Cl. ..... 205/149; 205/145; 205/273

[58] Field of Search ..... 205/144, 145, 205/149, 273

[56] References Cited

U.S. PATENT DOCUMENTS 4,908,106 3/1990 Takeshima et al. ..... 204/23

FOREIGN PATENT DOCUMENTS 59-41489 3/1984 Japan .

59-89788 5/1984 Japan .

*Primary Examiner*—Kathryn Gorgos
*Assistant Examiner*—Edna Wong
*Attorney, Agent, or Firm*—Eugene Lieberstein

[57] ABSTRACT

A method of electroplating particulates in a metallic ion containing electrolyte within an electroplating device having an anode and cathode plate by repeating the steps of stirring the particulates, allowing sedimentation of the particulates to occur by gravity until a sedimentation layer of loosely contacted particles is formed on the cathode plate of a suitable thickness and applying an electromotive potential across said anode and cathode plate to create an electric current in said electrolyte for electroplating metallic ions on the surface of the particulates in said sedimentation layer wherein the steps of stirring, sedimentation and electroplating are performed in sequence over repeated cycles which are maintained essentially independent of one another with the step of electroplating being interrupted during the steps of stirring and sedimentation and with the step of stirring immediately following the step of electroplating.

10 Claims, 3 Drawing Sheets

METHOD FOR ELECTROPLATING OF MICRON PARTICULATES WITH METAL COATINGS

This is a continuation-in-part of U.S. patent application Ser. No. 08/796,204, filed Feb. 7, 1997, now abandoned.

BACKGROUND OF THE INVENTION

This invention relates to a method for electroplating of micron particulates with metal or alloy coatings.

Particulates of small size in micrometer order, which include particles, platelets, flakes, whiskers and short or chopped fibers, have been well developed and been widely used as additives, reinforcements and functional elements in plastics, metals or alloys, ceramics and other materials to greatly improve the performance of the products.

Based on the excellent properties of base particulates, since metal coated particulates introduce extra properties of metal coatings and an improved surface, they represent another generation of composite particulates and have important applications in many areas.

Metal coatings on the particulates can be obtained by many techologies, such as chemical vapor deposition (CVD) process, physical vapor deposition (PVD) process and autocatalytic (electroless) plating process. However, the drawbacks of these processes include limited kinds of metal which can be coated on the particulates, relatively low metal deposition rate and high cost.

It is well known that, compared to other coating processes, the electroplating process has the advantage of high coating efficiency, high coating quality, versatility in various metal and alloy coatings, wide range of coating thickness and relatively low cost. However, the small size (<300 $\mu$m), irregular morphology and high specific surface area of the small sized (<300 $\mu$m) particulates made it impossible to use conventional electroplating processes to obtain metal coatings on these micron particulates.

SUMMARY OF THE INVENTION

This invention provides a simple and effective method for electroplating of various micron particulates with high quality metal or alloy coatings. The materials of the particulates can be metal or alloy, carbon (graphite), intermetallic compound, ceramic and polymer. The morphologies of the particulates can be particles, platelets, flakes, whiskers and short or chopped fibers. The size of the particulates can be varied from submicron to hundreds of micrometers. The metal coatings can be pure metal, alloy and multilayer metals. The metal or alloy coatings can be those available in conventional electroplating processes.

The invention broadly comprises a method of electroplating particulates, comprising immersing the particulates in a metallic ion-containing electrolyte in an electroplating device having an anode and a cathode plate, stirring the particulates in the electrolyte, allowing the particulates to sedimentate to the cathode plate to form a loosely contacted particle sedimentation, and, applying an electromotive potential across the anode and cathode plate to create an electric current in the electrolyte and deposit metallic ions in the electrolyte on the surface of the particulates.

DETAILED DESCRIPTION OF THE PREFERRED EMBODIMENTS

For electrically conductive particulates, such as metal, alloy, intermetallic compound and graphite, the method described in the following can be directly used to obtain the desired metal coating and coating thickness or amount of metal coating. For electrically non-conductive particulates, such as ceramic and polymer, the particulates should be metallized by using other technology, such as CVD, PVD or electroless plating process, but only for the purpose of making the surface of non-conductive particulates electrically conductive, and then following by using this method to obtain desired metal coating and coating thickness or amount of metal coating.

The basic principle of this invention is based of the effects existing in the electroplating process. In electroplating, a positive potential is applied on the anode and a negative potential is applied on the cathode. The potential difference between the anode and cathode is the driving force for metal ions to move from anode to cathode and to discharge and deposit on the cathode. Thus, one effect is that the metal ions move to the cathode and prefer to deposit on the site where the potential is more negative, which is called the negative potential effect in this invention. Another effect is that, if there are multiple cathodes in the electrolyte cell, the metal ions prefer to deposit on the cathodes closer to the anode, which is called the shielding effect in this invention. The combination of these two effects can be used to explain the effectiveness of this invention.

Figure 1:
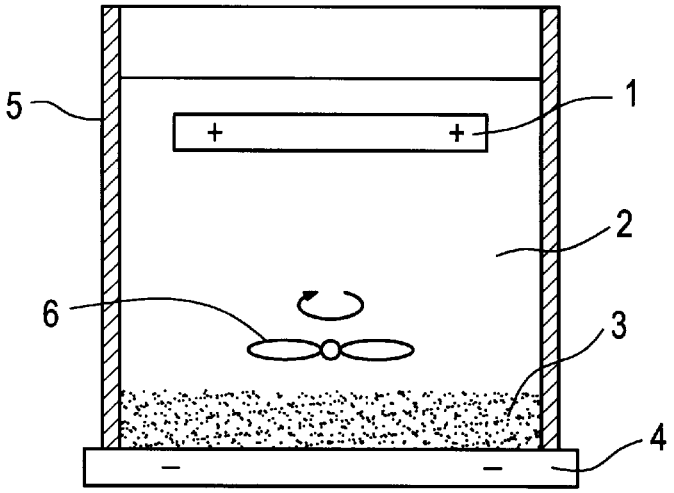
FIG. 1 schematically represents the process for lot electroplating of particulates with metal coating.

The preferred embodiment of the present invention is illustrated in FIG. 1, which shows the lot process. Electrolyte 2 is contained in a container 5. Anode 1 and particulates 3 are immersed in the electrolyte. A negative electrode 4 is placed on the bottom of the container 5. A positive potential is applied on anode 1, and a negative potential is applied on the particulates 3 (serve as cathodes) through negative electrode 4. The anode 1 can be made of the same material as the metal coating, or a non-dissolvable material, such as graphite, and can be any shape. The negative electrode 4 can be any electrically conductive material and any shape.

There are two methods of electroplating using the process illustrated in FIG. 1. One method is to stir the particulates 3 while performing electroplating. In this way, the particulates 3 keep moving during electroplating. The amount of the particulates 3 which are mixed with the electrolyte 2 can be small (somewhat like a muddy solution) or large (somewhat like a slurry). In either case, the efficiency of electroplating is low. Because of the electrical resistance of electrolyte 2, the electrical potentials of the particulates 3 vary with various position in the electrolyte 2. The particulates which are closer to negative electrode 4 tend to have more negative potential. In some positions, the potential difference between the particulates 3 and the anode 1 will not be sufficient for metal ions to discharge and deposit on the particulates. Although there exists the shielding effect, the negative potential effect is not negligible in this case. The metal ions in the electrolyte 2 tend to deposit on the particulates 3 closer to the negative electrode 4, and most prefer to deposit on the negative electrode 4. On the particulates 3 closer to the anode 1, the metal deposition rate tends to be low or in some cases no deposition occurs. In the case when the particulates 3 come into contact with the anode 1, the metal coatings will redissolve into the electrolyte 2. Although the uniform metal coatings still can be obtained through the movement of the particulates 3, the metal deposition rate will be low, together with a considerable amount of metal deposition on the negative electrode 4, which also contaminates the negative electrode 4.

Another method is preferred in this invention. In this method, the particulates 3 are stirred by stirrer 6 and mixed with electrolyte 2, and then sedimentate on the negative electrode 4. After the sedimentation of the particulates 3, the electroplating is performed. This way is also called the gravity sedimentation process in this invention. Since the sedimentated particulates 3 contacted one another, the potential variation among the particulates will be small compared to the first method. In this case, compared to the first method, the negative potential effect becomes weaker and the shielding effect becomes stronger. Furthermore, there exist interstices or channels among the loosely contacted particulates 3, which allow the electrolyte 2 and the metal ions to penetrate into the loosely contacted particulates. Thus combined with the negative potential effect and the shielding effect, the metal ions can be deposited on the sedimentated particulates 3 in a certain depth. In this way, if the thickness of the sedimentated particulates 3 is adjusted so that only the particulates from the upper surface to the very bottom near the negative electrode 4 can be deposited with metal, the deposition of metal on the electrode 4 can be avoided. The optimum thickness of the sedimentated particulates 3 depends on many factors which include the throwing and covering powers of the electroplating electrolyte, position of the anode 1 and the density, morphology, size, and conductivity of the particulates 3. Usually this optimum thickness is in the range from 1 mm to 50 mm. The anode 1 should be placed at an adequate distance to the upper surface of the sedimentated particulates 3 in order to avoid no occurrence of metal deposition or redissolution of metal coating on the particulates 3, as described in the first method. Usually this distance should be larger than 5 mm.

Although the negative electrode 4 can be any electrically conductive material, optimally the electrode should be made of a material which is difficult to coat with metal. An example is to use aluminum or its alloy. By doing so, even the thickness of the sedimentated particulates 3 is less than the optimum thickness, there will be no metal deposit or very small amount of loose metal deposit (which is easily removable) on the negative electrode 4, thus keeping the electrode 4 clean and enhancing the efficiency of the electroplating on the particulates 3.

In the gravity sedimentation process, because of the shielding effect, the amount of the metal coating will slightly decrease from the upper surface to the bottom of the sedimentated particulates 3. For best results, when using thicker sedimentated particulates 3 (still within the optimum thickness), a stirring step should be adopted after a period of electroplating. The stirrer 6 can be a magnetic stirring bar, stirring blade, cycling fluid flow, injecting air bubbles, rotating negative electrode 4, etc. During stirring, the electroplating should be stopped to avoid the problems described in the first method. During the stirring step, the particulates 3 with various thickness coatings are uniformly mixed and any possible metal coating bridge can be broken. After the stirring step, the next electroplating step is performed. By cycling stirring-sedimentation-electroplating steps, high quality and uniform metal coatings on the particulates 3 can be obtained, together with a high metal deposition rate.

Figure 2:
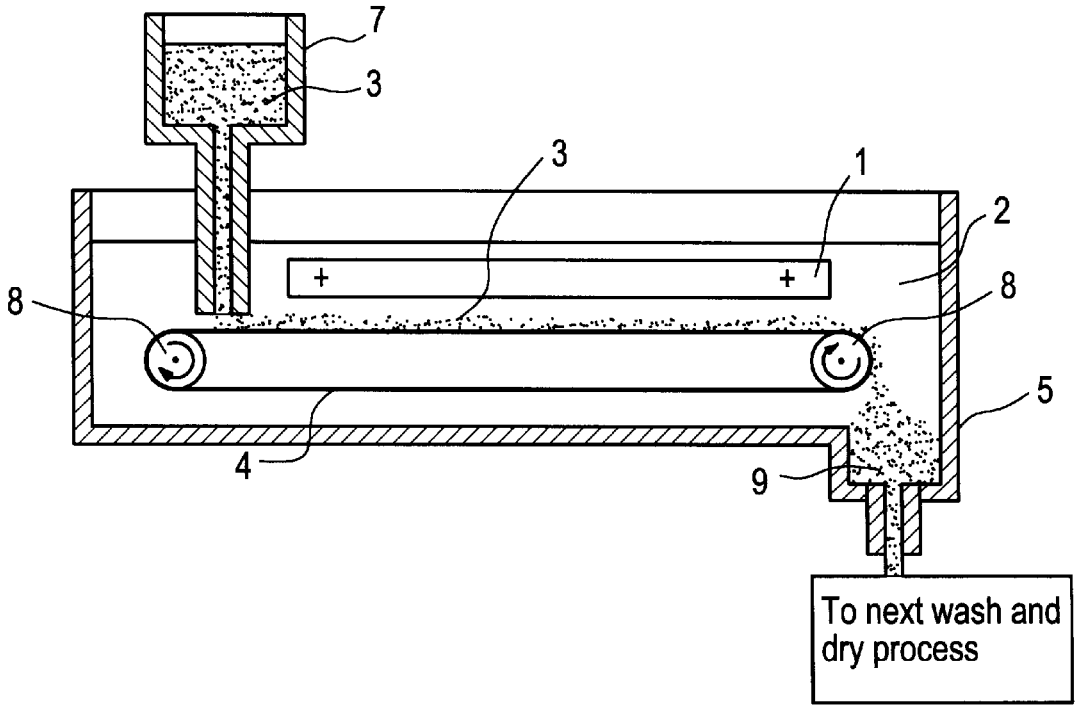
FIG. 2 schematically represents the process for continuous electroplating of particulates with metal coating.
Figure 3A:
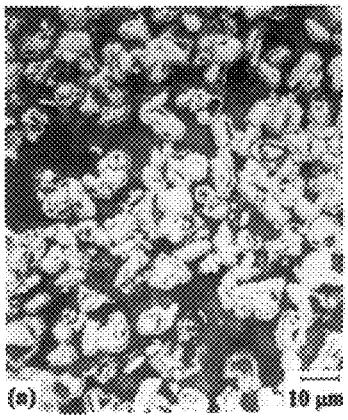
FIGS. 3(*a*) to 3(*d*) show optical micrographs of some metal coated particulates prepared by lot plating process (bright metal coating rings surrounded particulates and epoxy resin (dark area)): 3(*a*) Cu coated $TiB_2$ platelets; 3(*b*) Co coated Nd—Fe—B intermetallic compound platelets.
Figure 3B:
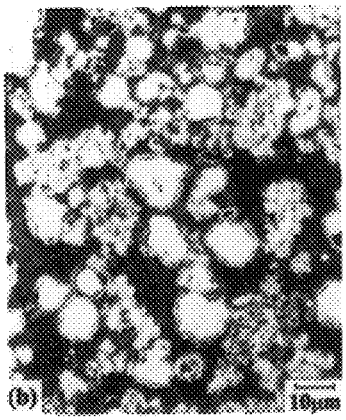
Figure 3C:
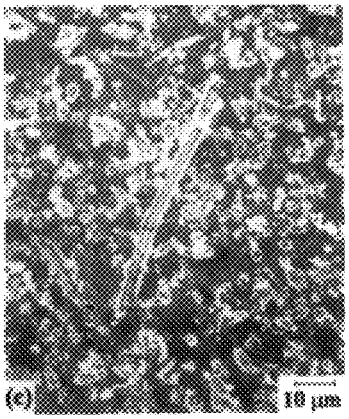
Figure 3D:
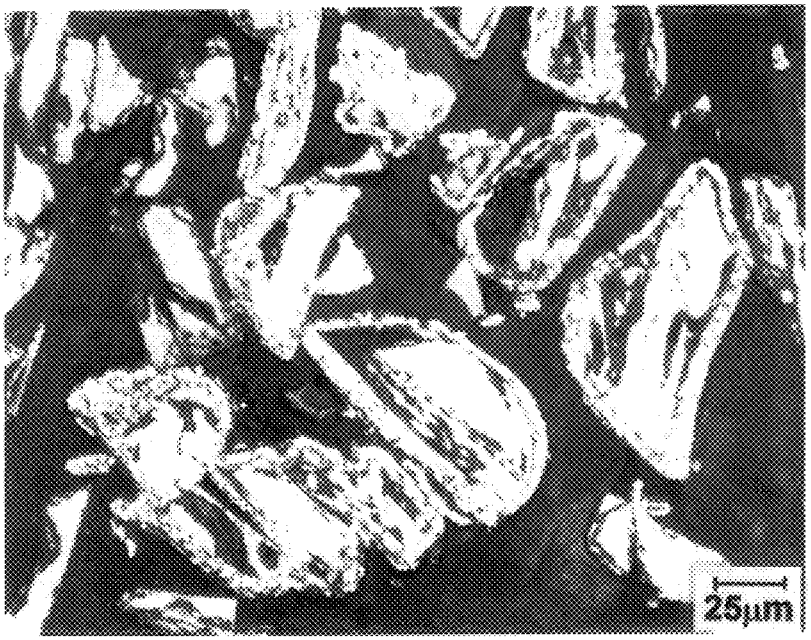
Figure 4:
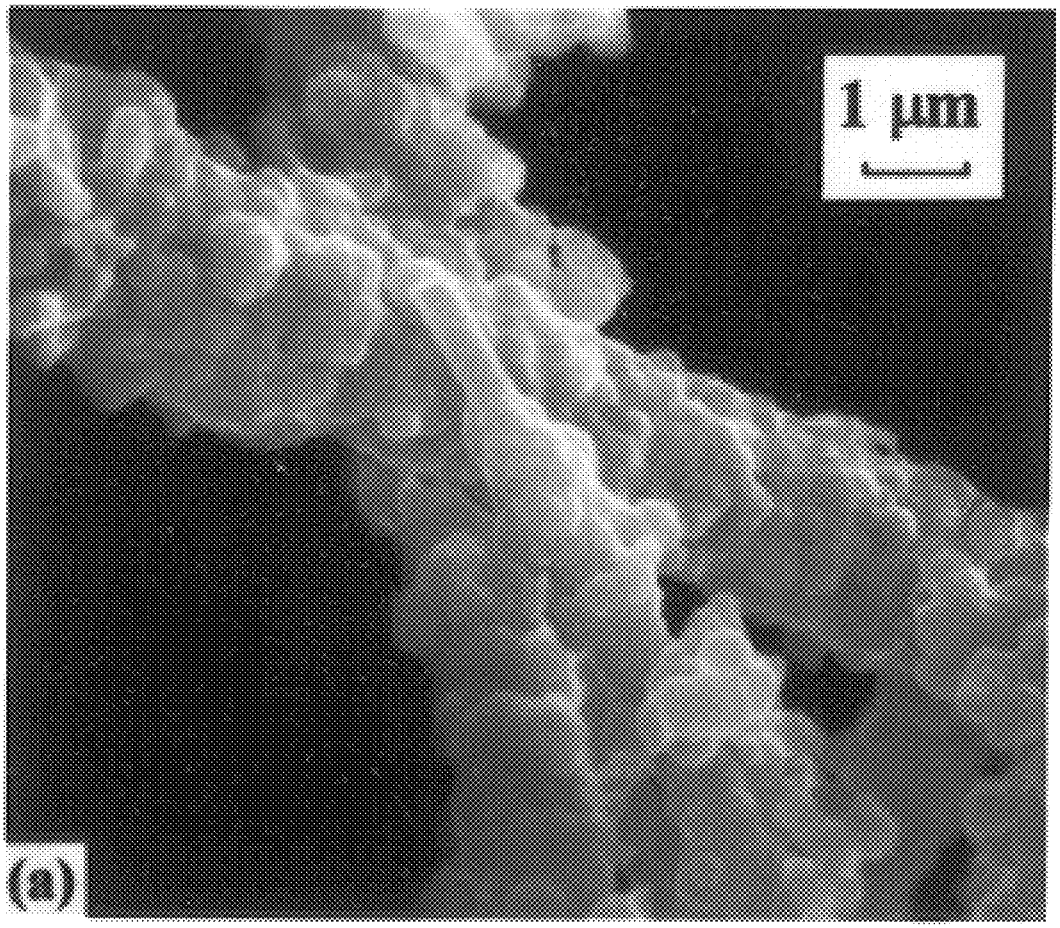
FIG. 4 shows a scanning electron micrograph of Cu coated SiC whiskers.

The principle of the lot process of this invention shown in FIG. 1 is also applied to the continuous process illustrated in FIG. 2. In FIG. 2, the particulates 3 contained in hopper 7 are fed to the negative electrode 4 (conductive moving belt). The belt electrode 4 is driven by driving wheels 8 which also serves to apply negative potential to the electrode 4. The metal coated particulates 9 sedimentate and discharge to the next washing and drying process. During the continuous electroplating process, if the thickness of the sedimentated particulates 3 remains reasonably thin (less than 5 mm), it is not necessary to use a stirring step.

By using the method described in this invention, various high quality metal coatings on micron particulates have been obtained. They include Cu coated Mo particles, Cu coated SiC whiskers, Cu coated $TiB_2$ platelets, Cu coated graphite flakes, Cu coated Nd—Fe—B intermetallic compound platelets, Cu coated short carbon fibers, Ni coated short carbon fibers, Ni coated SiC whiskers, Ni coated graphite flakes, Ni coated Al powder, Ni coated BN powder, Zn coated Nd—Fe—B intermetallic compound platelets, Co coated Nd—Fe—B intermetallic compund platelets, Cu/Zn double layer coated Nd—Fe—B intermetallic compound platelets, Co/Zn double layer coated Nd—Fe—B intermetallic compound platelets, etc.

FIGS. 3(*a*) to 3(*d*) and 4 show optical and SEM micrographs of some metal coated particulate samples by using lot process described in this invention.

To summarize the electroplating process of the present invention:

1. Electrically conductive particulates
   A one step electroplating process can be used to coat electrically conductive particulates (such as metal, alloy, intermetallic compound, graphite, etc.) with metals.
2. Electrically non-conductive particulates
   An electroless (autocatalytic) plating process is used for the purpose of metallizing the surface of particulates to make them electrically conductive. The main part of metal coating on particulates is obtained by subsequent electroplating process.
3. One cycle of process
   One cycle of the process comprises three steps:
   The first step is stirring. In the stirring step, the particulates loaded in metal ion-containing electrolyte in a electroplating bath are vigorously stirred by mechanical method (using such as magnetic stirring bar, mechanical stirring blade, circulating fluid flow, injecting air bubble, rotating negative electrode, etc.). The purpose of stirring is to disperse particulates uniformly in the electrolyte, break any possible metal bridges among the particulates during electroplating step and eliminate any concentration gradient of metal ions in the electrolyte caused by high coating rate electroplating process.
   The second step is sedimentation. In this step, the stirring step is stopped to let suspended particulates sedimentate down to the cathode plate by gravitational force to form a loosely contacted particulate sedimentation. In this step, the loosely contacted particulate sedimentation can provide channels for metal ions to diffuse or penetrate to the surface of every particle in the sedimentation layer, thus to ensure that the metal ion discharge and deposition can take place on all particulates in the sedimentation layer at same time, thus results in a high coating rate.

The third step is the electroplating step. In this step, when most particulates (>90%, not necessarily 100%) sedimentated on the cathode plate, a predetermined electric current is passed between anode and cathode plate to reduce and deposit metal ions in the electrolyte on the surfaces of all particulates in the sedimentation layer. The electric current can be DC current, DC current plus pulse current or cycling reverse current as usually used in conventional electroplating processes.

By repeating the process cycle mentioned above, metal coated particulates with required metal content and high coating quality (each particulate coated with continuous and uniform metal layer) together with very high coating rate can be obtained.

To obtain high deposition efficiency or avoid metal ions deposit on the cathode plate, a hard-to-plate material by electroplating process (such as aluminum and titanium) is used as cathode plate and also in the stirring step and the sedimentation step no electric current is introduced.

EXAMPLES

The following examples illustrate the utility of the present invention:

Example 1

In this example, equiaxed molybdenum particles having an average particle diameter of about 4.5 $\mu$m and density of 10.22 g/cm$^3$ were electroplated with copper.

An electroplating apparatus mentioned in this invention was used. The tubular vessel was made of glass. A copper woven wire (1 mm of wire diameter) was used as copper plating anode to increase anode surface area. An aluminum cathode plate was disposed on the bottom of vessel. A copper electroplating aqueous solution containing 60 g/liter of copper pyrophosphate, 300 g/liter of potassium pyrophosphate and 25 g/liter of ammonia citrate was charged into a electroplating apparatus. The molybdenum particles were loaded in a copper electroplating aqueous solution in the electroplating apparatus. The proportion of Mo particles to electrolyte solution per square decimeter of cathode plate is (100 gram:0.5 liter)/dm$^2$.

In the first stirring step, the particulates in the electrolyte solution were vigorously stirred for 20 seconds by mechanical stirring blade at speed of 800 rpm, then stopped. The time for sedimentation step was 40 seconds. The thickness of molybdenum particle sedimentation layer was about 15 mm. The distance of copper anode to the top of sedimentation layer was 30 mm. During the stirring and sedimentation steps, no current was passed between anode and cathode plate. In the electroplating step, DC current was passed between anode and cathode. The current density was 18 A/dm$^2$ of cathode plate with applied DC voltage of 9 volts. The electroplating time was 4 minutes.

Repeat the cycle of three steps mentioned above such that the total electroplating time was 2 hours. During electroplating process, the electrolyte solution temperature was kept at 40~50° C. The weight of plated copper was 30% on average based on weight of the copper coated molybdenum particles. The micrograph of polished section of copper coated molybdenum particles showed that each molybdenum particle was coated with continuous and uniform copper coating.

Example 2

Using the same apparatus and copper electroplating aqueous solution of example 1, titanium-diboride ($TiB_2$) platelets having an average size of 4 $\mu$m and density of 4.5 g/cm$^3$ were electroplated with copper. Before electroplating, the starting $TiB_2$ platelets were electroless plated with thin copper film to make them electrically conductive. In electroless plating, the $TiB_2$ platelets were soaked in a stannous chloride aqueous solution containing 10 g/liter of $SnCl_2 2H_2O$ and 40 ml/liter of HCl (37%) at ambient temperature for 10 minutes. The sensitized platelets were then washed with water, soaked in an palladium chloride aqueous solution containing 0.5 g/liter of $PdCl_2$ and 10 ml/liter of HCl at ambient temperature for 15 minutes. The activated platelets were then washed with water. Electroless plating of activated $TiB_2$ platelets was conducted at a temperature of 55~65° C. for 10 minutes using an copper electroless aqueous solution containing 7 g/liter of $CuSO_4.5H_2O$, 34 g/liter of $KNaC_4H_4O_6.4H_2O$ and 10 g/liter of NaOH together with 50 ml/liter of formaldehyde solution (37%) as reducing agent. The thickness of the thin copper film electroless plated on the platelet was about 0.05 $\mu$m. The copper electroless plated $TiB_2$ platelets were then washed with water and ready to be electroplated with copper.

The proportion of $TiB_2$ platelets to electroplating solution per square decimeter of cathode plate is (40 gram:0.5 liter)/dm$^2$. The time for stirring step is 20 seconds. The time for sedimentation step was 60 seconds. The thickness of $TiB_2$ platelet sedimentation layer was about 20 mm. The distance of copper anode to the top of sedimentation layer was 30 mm. During stirring step and sedimentation step, no current was passed between anode and cathode plate. In electroplating step, DC current was passed between anode and cathode. The current density was 18 A/dm$^2$ of cathode plate with applied DC voltage of 10 volts. The time for electroplating time is 2 minutes.

Repeat the cycle of three steps mentioned above such that the total electroplating time was 1.5 hours. During electroplating process, the electrolyte solution temperature was kept at 40~50° C. The weight of plated copper was 45% on average based on weight of the copper coated titanium-diboride particles. The micrograph of polished section of copper coated $TiB_2$ platelets showed that each $TiB_2$ platelet was coated with continuous and uniform copper coating.

Example 3

Using the same apparatus and copper electroplating aqueous solution of example 1, silicon-carbide (SiC) whiskers having an average diameter of 0.5 $\mu$m, aspect ratio of 15 and density of 3.2 g/cm$^3$ were electroplated with copper. Before electroplating, the starting SiC whiskers were electroless plated with thin copper film using the same electroless plating process of example 2. The thickness of the thin copper film electroless plated on the SiC whisker was about 0.1 $\mu$m.

The proportion of SiC whiskers to electroplating solution per square decimeter of cathode plate is (10 gram:0.5 liter)/dm$^2$. The time for stirring step is 20 seconds. The time for sedimentation step was 90 seconds. The thickness of SiC whisker sedimentation layer was about 25 mm. The distance of copper anode to the top of sedimentation layer was 30 mm. During stirring step and sedimentation step, no current was passed between anode and cathode plate. In electroplating step, DC current was passed between anode and cathode. The current density was 16 A/dm$^2$ of cathode plate with applied DC voltage of 9 volts. The time for electroplating time is 2 minutes.

Repeat the cycle of three steps mentioned above such that the total electroplating time was 1.0 hours. During electroplating process, the electrolyte solution temperature was kept at 40~50° C. The weight of plated copper was 67% on average based on weight of the copper coated silicon-carbide whiskers. The micrograph of polished section of copper coated SiC whiskers showed that each SiC whisker was coated with continuous and uniform copper coating.

Example 4

Using the same apparatus of example 1 except for using nickel plate as anode and titanium sheet as cathode plate, graphite flakes having an average size of 200 $\mu$m and density of 1.9 g/cm$^3$ were electroplated with nickel. No electroless plating process was needed for modification of graphite flake surface since they are electrically conductive.

A nickel electroplating aqueous solution containing 150 g/liter of nickel sulfate, 25 g/liter of ammonium chloride and 25 g/liter of boric acid was used in this example. The proportion of graphite flakes to electroplating solution per square decimeter of cathode plate is (20 gram:0.5 liter)/dm$^2$. The time for stirring step is 20 seconds. The time for sedimentation step was 30 seconds. The thickness of graphite flake sedimentation layer was about 20 mm. The distance of nickel anode to the top of sedimentation layer was 30 mm. During stirring step and sedimentation step, no current was passed between anode and cathode plate. In electroplating step, DC current was passed between anode and cathode. The current density was 18 A/dm$^2$ of cathode plate with applied DC voltage of 10 volts. The time for electroplating time is 4 minutes.

Repeat the cycle of three steps mentioned above such that the total electroplating time was 1.0 hours. During electroplating process, the electrolyte solution temperature was kept at 30~40° C. The weight of plated nickel was 50% on average based on weight of the nickel coated graphite flakes.

Example 5

Using the same apparatus and nickel electroplating aqueous solution of example 4, short carbon fibers having a diameter of 8 $\mu$m, length of 2 mm and density of 1.8 g/cm$^3$ were electroplated with nickel. No electroless plating process was needed for modification of short carbon fiber surface since they are electrically conductive.

The proportion of short carbon fiber to electroplating solution per square decimeter of cathode plate is (8 gram:0.5 liter)/dm$^2$. The time for stirring step is 20 seconds. The time for sedimentation step was 40 seconds. The thickness of short carbon fiber sedimentation layer was about 50 mm. The distance of nickel anode to the top of sedimentation layer was 20 mm. During stirring step and sedimentation step, no current was passed between anode and cathode plate. In electroplating step, DC current was passed between anode and cathode. The current density was 15 A/dm$^2$ of cathode plate with applied DC voltage of 9 volts. The time for electroplating time is 5 minutes.

Repeat the cycle of three steps mentioned above such that the total electroplating time was 30 minutes. During electroplating process, the electrolyte solution temperature was kept at 30~40° C. The weight of plated nickel was 50% on average based on weight of the nickel coated short carbon fibers.

Example 6

Using the same apparatus of example 4 except for using cobalt plate as anode, Nd—Fe—B intermetallic magnet platelets having an average size of 80 $\mu$m and density of 7.5 g/cm$^3$ were electroplated with cobalt. No electroless plating process was needed for modification of Nd—Fe—B intermetallic magnet platelets surface since they are electrically conductive.

A cobalt electroplating aqueous solution containing 300 g/liter of cobalt sulfate, 30 g/liter of boric acid and 20 g/liter of potassium chloride was used in this example. The proportion of Nd—Fe—B intermetallic magnet platelets to electroplating solution per square decimeter of cathode plate is (90 gram:0.5 liter)/dm$^2$.

The time for stirring step is 20 seconds. The time for sedimentation step was 15 seconds. The thickness of Nd—Fe—B intermetallic magnet platelet sedimentation layer was about 20 mm. The distance of cobalt anode to the top of sedimentation layer was 30 mm. During stirring step and sedimentation step, no current was passed between anode and cathode plate. In electroplating step, DC current was passed between anode and cathode. The current density was 20 A/dm$^2$ of cathode plate with applied DC voltage of 10 volts. The time for electroplating time is 4 minutes.

Repeat the cycle of three steps mentioned above such that the total electroplating time was 45 minutes. During electroplating process, the electrolyte solution temperature was kept at 30~40° C. The weight of plated cobalt was 15% on average based on weight of the cobalt coated Nd—Fe—B intermetallic magnet platelets.

Example 7

In this example, the same Nd—Fe—B intermetallic magnet platelets in example 6 were coated with Cu/Zn double coating layers where Cu was the base coating and Zn was the top coating. No electroless plating process was needed for modification of Nd—Fe—B intermetallic magnet platelets surface since they are electrically conductive.

Using the same apparatus and copper electroplating aqueous solution of example 1 to perform electroplating of base Cu coating on Nd—Fe—B intermetallic magnet platelets. The proportion of Nd—Fe—B intermetallic magnet platelets to electroplating solution per square decimeter of cathode plate is (90 gram:0.5 liter)/dm$^2$. The time for stirring step is 20 seconds. The time for sedimentation step was 15 seconds. The thickness of Nd—Fe—B intermetallic magnet platelet sedimentation layer was about 20 mm. The distance of copper anode to the top of sedimentation layer was 30 mm. During stirring step and sedimentation step, no current was passed between anode and cathode plate. In electroplating step, DC current was passed between anode and cathode. The current density was 18 A/dm$^2$ of cathode plate with applied DC voltage of 9 volts. The time for electroplating time is 1 minutes.

Repeat the cycle of three steps mentioned above such that the total electroplating time was 4 minutes. During electroplating process, the electrolyte solution temperature was kept at 30~40° C. The weight of plated copper was 5% on average based on weight of the copper coated Nd—Fe—B intermetallic magnet platelets.

Use the same apparatus but replace the copper electroplating aqueous solution with zinc electroplating aqueous solution for top zinc coating (second coating). The zinc electroplating aqueous solution contained 50 g/liter of zinc oxide, 30 g/liter of citric acid monohydrate and 260 g/liter of ammonium chloride. After washing, the base Cu coated Nd—Fe—B intermetallic magnet platelets were immediately put into the electroplating bath containing zinc electroplating aqueous solution.

The time for stirring step is 20 seconds. The time for sedimentation step was 15 seconds. The distance of zinc anode to the top of sedimentation layer was 30 mm. During stirring step and sedimentation step, no current was passed between anode and cathode plate. In electroplating step, the current density was 17 A/dm$^2$ of cathode plate with applied DC voltage of 8 volts. The time for electroplating time is 4 minutes.

Repeat the cycle of three steps mentioned above such that the total electroplating time was 50 minutes. During electroplating process, the electrolyte solution temperature was kept at 30~40° C. The weight of plated zinc was 15% on average based on weight of the Cu/Zn double layer coated Nd—Fe—B intermetallic magnet platelets.

Example 8

Using the same apparatus, copper electroless plating process and copper electroplating aqueous solution of example 2, ABS plastic spherical particles having an average diameter of 30 $\mu$m were electroplated with copper. After copper electroless plating, the thin copper film thickness on the particle is about 0.1 $\mu$m.

The proportion of ABS plastic spherical particles to electroplating solution per square decimeter of cathode plate is (20 gram:0.5 liter)/dm$^2$. The time for stirring step is 20 seconds. The time for sedimentation step was 30 seconds. The thickness of ABS plastic particle sedimentation layer was about 20 mm. The distance of copper anode to the top of sedimentation layer was 30 mm. During stirring step and sedimentation step, no current was passed between anode and cathode plate. In electroplating step, DC current was passed between anode and cathode. The current density was 16 A/dm$^2$ of cathode plate with applied DC voltage of 10 volts. The time for electroplating time is 2 minutes.

Repeat the cycle of three steps mentioned above such that the total electroplating time was 35 minutes. During electroplating process, the electrolyte solution temperature was kept at 35~45° C. The weight of plated copper was 35% on average based on weight of the copper coated ABS plastic spherical particles.

What I claim is:

1. A method of electroplating particulates comprising the steps of:

(a) immersing said particulates in a metallic ion-containing electrolyte in an electroplating device having an anode and a cathode plate, (b) stirring said particulates in said electrolyte, (c) forming a sedimentation layer of loosely contacted particulates on said cathode plate by allowing said particulates to sediment by gravity on said cathode plate, and (d) applying an electromotive potential across said anode and cathode plate to create an electric current in said electrolyte for electroplating metallic ions on the surface of the particulates in said sedimentation layer wherein the steps of (b) stirring, (c) forming a sedimentation layer and (d) electroplating are performed in sequence over repeated cycles with the electroplating step (d) essentially stopped when carrying out the steps of (b) stirring and (c) forming a sedimentation layer and with the step of (b) stirring immediately following the step of (d) electroplating, and wherein the step of stirring (b) is sufficiently vigorous to disperse the particulates from the sedimentation layer and to break up particulates bridged by metallic coating.

2. A method as recited in claim 1 wherein said sedimentation layer of particles has a minimum thickness of at least about 1 mm and wherein said particulates have an average size of less than 300 $\mu$m.

3. A method as recited in claim 1 wherein said particulates are selected from the group consisting of metal, alloy, intermetallic compound, carbon, graphite, ceramic and polymer.

4. A method as recited in claim 1 wherein said particulates are particles.

5. A method as recited in claim 1 wherein said particulates are platelets.

6. A method as recited in claim 1 wherein said particulates are flakes.

7. A method as recited in claim 1 wherein said particulates are whiskers.

8. A method as recited in claim 1 wherein said particulates are short or chopped fibers.

9. A method as recited in claim 1 wherein said cathode plate is comprised of aluminum or its alloys.

10. A method as recited in claim 1 wherein said cathode plate is comprised of titanium or its alloys.

* * * * *